US010390674B2

(12) United States Patent
Walz et al.

(10) Patent No.: US 10,390,674 B2
(45) Date of Patent: Aug. 27, 2019

(54) METHOD FOR CLEANING A FLOOR SURFACE AND FLOOR CLEANING DEVICE

(71) Applicant: Alfred Kärcher GmbH & Co. KG, Winnenden (DE)

(72) Inventors: Juergen Walz, Moeckmuehl (DE); Christian Hofner, Welzheim (DE); Barbara Pfister, Weissach im Tal (DE); Carsten Eckart, Ludwigsburg (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 84 days.

(21) Appl. No.: 15/274,123

(22) Filed: Sep. 23, 2016

(65) Prior Publication Data

US 2017/0007091 A1 Jan. 12, 2017

Related U.S. Application Data

(63) Continuation of application No. PCT/EP2014/055853, filed on Mar. 24, 2014.

(51) Int. Cl.

| | |
|---|---|
| ***A47L 11/40*** | (2006.01) |
| ***A47L 11/282*** | (2006.01) |
| ***A47L 11/30*** | (2006.01) |

(52) U.S. Cl.

CPC ..... *A47L 11/4011* (2013.01); *A47L 11/282* (2013.01); *A47L 11/302* (2013.01); *A47L 11/4008* (2013.01); *A47L 2201/04* (2013.01); *A47L 2201/06* (2013.01)

(58) Field of Classification Search

None

See application file for complete search history.

(56) References Cited

U.S. PATENT DOCUMENTS

| | | | |
|---|---|---|---|
| 5,613,261 | A | 3/1997 | Kawakami et al. |
| 9,388,543 | B2 | 7/2016 | Cacciotti |

FOREIGN PATENT DOCUMENTS

| | | |
|---|---|---|
| CN | 201929883 | 8/2011 |
| CN | 202136279 | 2/2012 |
| CN | 102613944 | 8/2012 |
| CN | 103603483 | 2/2014 |
| DE | 10 2011 006 062 | 9/2012 |
| DE | 20 2011 051 936 | 2/2013 |
| EP | 1 967 116 | 9/2008 |
| EP | 2 387 931 | 11/2011 |
| KR | 10 2011 127 946 | 11/2011 |

*Primary Examiner* — Eric W Golightly

(74) *Attorney, Agent, or Firm* — Womble Bond Dickinson (US) LLP

(57) ABSTRACT

The invention relates to a method for cleaning a floor surface with a floor cleaning device, in which method, during the cleaning movement of the floor cleaning device over the floor surface, a first recording of a floor surface portion before the cleaning is created with an optical recording unit, the floor cleaning device is moved with at least one cleaning unit over the floor surface portion, which is cleaned, a second recording of the floor surface portion after the cleaning is created with an optical recording unit and the recordings are compared with one another in order to check the cleaning result. The invention further relates to a floor cleaning device for carrying out the method.

29 Claims, 4 Drawing Sheets

METHOD FOR CLEANING A FLOOR SURFACE AND FLOOR CLEANING DEVICE

CROSS-REFERENCE TO RELATED APPLICATIONS

This application is a continuation patent application of international application number PCT/EP2014/055853 filed on Mar. 24, 2014, which is incorporated herein by reference in its entirety and for all purposes.

FIELD OF THE INVENTION

The invention relates to a method for cleaning a floor surface with a floor cleaning device.

The invention further relates to a floor cleaning device for carrying out the method.

The floor cleaning device can be a self-propelling and self-steering floor cleaning device with which an autonomous cleaning of the floor surface can be carried out. Alternatively or additionally, the floor cleaning device can be operable by an operating person, whereby it is, in particular, a manually guided floor cleaning device (e.g., a walk-behind device) or a ride-on floor cleaning device. Accordingly, the present invention relates also to a floor cleaning device which enables both autonomous cleaning of the floor surface as well as cleaning with operation by an operating person. The operation by the operating person can also take place under remote control, for example, from a remote-control center.

The present invention relates to the field of the verification of the cleaning result. A determination of whether the cleaning of the floor surface has taken place satisfactorily (hereinafter referred to as "sufficiently good cleaning") is desirable.

BACKGROUND OF THE INVENTION

It is known to create a map of the floor surface to be cleaned before the cleaning and to store the degree of dirtiness of the floor surface position-dependently. For example, a method is described in U.S. Pat. No. 5,613,261 wherein, depending on the stored degree of dirtiness, an intensive cleaning can be carried out for heavy dirt or just a basic cleaning for normal dirt.

DE 10 2011 006 062 A1 also describes a position-dependent storage of the degree of dirtiness of the floor surface.

In EP 1 967 116 A1, a method is described in which the degree of dirtiness of the floor surface during a cleaning procedure is stored position-dependently. During a later processing, the travel direction and the processing intensity of a suction unit and a cleaning brush can be controlled dependent upon the degree of dirtiness.

DE 20 2011 051 936 U1 describes a device for cleaning windows, facade elements, solar modules and the like. Arranged in the region of a cleaning head is a sensor apparatus for detecting the dirtiness state of the surface to be cleaned. With the sensor apparatus, for example, an optical camera, the cleaning effect can also be checked.

An object underlying the present invention is to provide a method for cleaning a floor surface with a floor cleaning device and also a floor cleaning device for carrying out the method, with which a good cleaning result is achievable in a constructionally simple manner.

SUMMARY OF THE INVENTION

In a first aspect of the invention, the aforementioned object is achieved by a method for cleaning a floor surface with a floor cleaning device, in which method, during the cleaning movement of the floor cleaning device over the floor surface, a first recording of a floor surface portion before the cleaning is created with an optical recording unit, the floor cleaning device is moved with at least one cleaning unit over the floor surface portion, which is cleaned, a second recording of the floor surface portion after the cleaning is created with an optical recording unit and the recordings are compared with one another in order to check the cleaning result.

In a second aspect of the invention, the aforementioned object is achieved by a floor cleaning device for carrying out the method mentioned above, comprising a carriage for traveling on a floor surface, at least one cleaning unit for cleaning the floor surface and at least one optical recording unit, wherein during the cleaning movement of the floor cleaning device over the floor surface, a first recording of a floor surface portion before the cleaning is creatable with the at least one optical recording unit, the floor cleaning device is movable with the at least one cleaning unit over the floor surface portion and this is cleanable, and a second recording of the floor surface portion after the cleaning is creatable with the at least one optical recording unit, wherein the recordings are comparable with one another in order to check the cleaning result.

BRIEF DESCRIPTION OF THE DRAWINGS

The foregoing summary and the following description may be better understood in conjunction with the drawing figures, of which.

DETAILED DESCRIPTION OF PREFERRED EMBODIMENTS OF THE INVENTION

Figure 1:
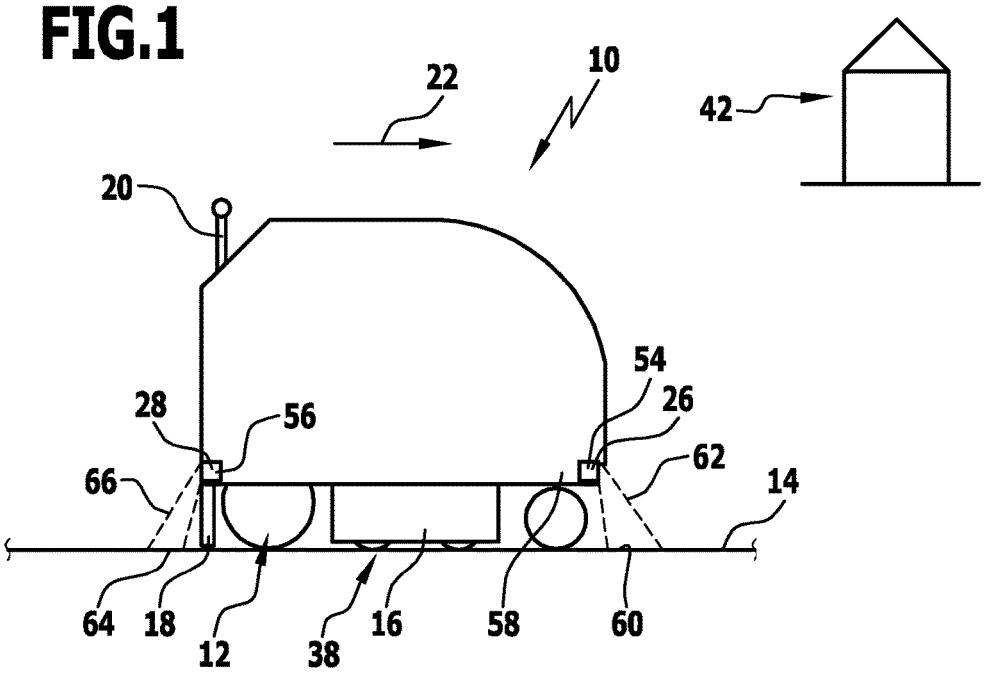
FIG. 1 is a schematic side view of a floor cleaning device in accordance with the invention.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a method for cleaning a floor surface with a floor cleaning device. During the cleaning movement of the floor cleaning device over the floor surface, a first recording of a floor surface portion before the cleaning is created with an optical recording unit, the floor cleaning device is moved with at least one cleaning unit over the floor surface portion, which is cleaned, and a second recording of the floor surface portion after the cleaning is created with an optical recording unit. The recordings are compared with one another in order to check the cleaning result.

In the method in accordance with the invention, the cleaning result can be determined during the ongoing cleaning operation wherein the floor cleaning device moves autonomously over the floor surface or is moved over it by an operating person. Two recordings of a floor surface portion are created with at least one optical recording unit. A first recording is created before the cleaning of the floor surface portion. The first recording can be temporarily stored, for example, in a memory unit of the floor cleaning device. Subsequently, the floor surface portion is cleaned with at least one cleaning unit. A second recording of the floor surface portion is created with the at least one recording unit after the cleaning and is compared with the first recording. As early as during the ongoing cleaning of the floor surface, it can be determined on the basis of the recordings whether the cleaning result is satisfactory and a sufficiently good cleaning has been achieved. This provides the possibility, in a case of insufficient cleaning, of obtaining an early remedy. In particular, a renewed cleaning of the not sufficiently well cleaned floor surface portion can be carried out immediately. The method in accordance with the invention thereby provides the possibility that following completion of the cleaning of the floor surface, checking of whether the cleaning result is satisfactory can be omitted. By this means, cleaning processes can be carried out more quickly. In a corresponding manner, a position-dependent storage of the degree of dirtiness before the commencement of the cleaning operation, as known from the prior art, can be omitted. Instead, the processing of the floor surface can be begun immediately and the cleaning result can be checked during the ongoing cleaning. In this way also, cleaning tasks can be carried out swiftly. Positional errors such as can occur during localization of the floor cleaning device on the floor surface, achieve a significantly lower importance through the method in accordance with the invention than through the methods described in the prior art. Since the recordings of the floor surface portion can be created at relatively rapidly sequential time points, there is a high degree of certainty in the position determination of the floor cleaning device and accordingly certainty that in both recordings, the same floor surface portion has been recorded. Accordingly, positional inaccuracies have a stronger effect with previous creation of a complete dirtiness map of the floor surfaces and a more frequent position checking is necessary. This reduces the cleaning speed and thereby prolongs the cleaning procedure. Due to the method in accordance with the invention, accordingly with simple checking, rapid cleaning of the floor surface can be achieved. The present method is also very well suited to the documentation of the cleaning result, for example, that cleaning orders issued to a contractor have been carried out satisfactorily.

The cleaning direction preferably extends in the longitudinal direction of the floor cleaning device.

It is advantageous if a camera, in particular a digital camera, is used as the optical recording unit and if the recordings are images of the floor surface portion. By means of the at least one optical recording unit configured as a camera, spatially resolved images of the floor surface portion can be created. Dirt before, or the lack of dirt after the cleaning of the floor surface portion can thereby be recognized in a simple manner.

It proves to be advantageous if two optical recording units are used in order to create the first recording and the second recording, wherein the first recording unit is provided for creating the first recording and, relative to a cleaning direction, is directed toward the floor surface in front of the at least one cleaning unit, and wherein the second recording unit is provided for creating the second recording and is directed toward the floor surface behind the at least one cleaning unit. Before the cleaning of the floor surface portion, a recording with the first recording unit (for example, a camera) can be created, wherein the recording unit is directed toward a floor surface portion located, in the cleaning direction, in front of the cleaning unit. Following the cleaning of the floor surface portion, the second recording with the second recording unit (for example, a camera) is created. The second recording unit is directed to a floor surface portion located, in the cleaning direction, behind the cleaning unit. The floor surface portion recorded in each case is identical. Between the creation of the two recordings, the floor cleaning device has moved over the floor surface.

Alternatively or additionally, it can be provided that one optical recording unit which creates the first recording and the second recording is used. In particular, both recordings can be created with just one recording unit at successive time points.

In the last-mentioned advantageous exemplary embodiment, it can be provided that the recording unit has or provides a viewing field which is directed both in front of the at least one cleaning unit and also behind it, relative to the cleaning direction.

Alternatively or additionally, it is favorable if at least one optical recording unit is movably mounted on the floor cleaning device and if the recording unit is moved relative to the floor cleaning device after the creation of the first recording to create the second recording. For example, initially, the first recording is created and subsequently the recording unit is pivoted, rotated or displaced relative to the floor cleaning device, whereupon the second recording is created. In particular, the recording unit is rotatable about at least one rotation axis perpendicular to the cleaning direction and perpendicular to a contact plane and/or parallel to a contact plane. The contact plane of the floor cleaning device coincides with the plane of the floor surface. The rotation axis can be oriented, in particular, vertically or horizontally.

It can be provided that the comparison of the recordings is undertaken by an operating person guiding or controlling the floor cleaning device at the machine itself or from a remote-control center, which will be considered further below.

Alternatively or additionally, it is advantageous if the comparison of the recordings is undertaken by a control unit of the floor cleaning device or by a control unit which is arranged remote from the floor cleaning device (for example, a remote-control center) and, at an indicating unit, at least if no sufficiently good cleaning of the floor surface portion has occurred, a corresponding indication is provided. Stored executably in the control unit are, for example, image processing algorithms which enable an automatic comparison of the recordings. At least one criterion which permits a classification of the cleaning result as sufficiently good or not sufficiently good can also be stored in the control unit. At least when the cleaning has not been carried out sufficiently well, an indication can be provided at the indicating unit. The indication can be regarded by an operating person as a suggestion or an instruction to clean the floor surface portion again.

If the control unit for comparison of the recordings is arranged in the remote-control center, the recordings can be transferred thereto via cooperating communication units.

Control commands from the operating person in the remote-control center can also be transferred via the communication units.

The indication can be stored, preferably linked to a position information item of the floor surface portion, wherein the position of the floor cleaning device on the floor surface is determined. For the purposes of the documentation, it is favorable, in particular, to store an indication that a sufficiently good cleaning has not taken place. Preferably, the indication is stored linked to the position information item. In this way, if required, the floor surface portion can be sought again and cleaned anew. A position-dependent storage of the indication is also advantageous for the purposes of the documentation.

It can be provided that the indication is provided at an indicating unit of the floor cleaning device and/or is stored in a memory unit of the floor cleaning device. Particularly in the case of a manually guided floor cleaning device, the operating person can be notified at the indicating unit that the floor surface portion should be cleaned again.

Alternatively or additionally, it can be provided that an indicating unit arranged remote from the floor cleaning device and/or a memory unit arranged remote from the floor cleaning device is used. For example, the floor cleaning device can be controlled from a spatially distant remote-control center in which the indicating unit is located. An operating person can control the floor cleaning device remotely and initiate a renewed cleaning of the floor surface portion.

The indicating unit is preferably, in particular, an optical display unit which comprises, for example, an image display.

A storage of the indication, preferably linked to a position information item of the floor surface portion is preferably also carried out if a sufficiently good cleaning has taken place. By this means, it can be documented that the floor surface portion has been sufficiently well cleaned and that, for example, a cleaning instruction has been carried out as ordered.

It is favorable if, in the case that the floor cleaning device is a self-propelling and self-steering floor cleaning device and no sufficiently good cleaning of the floor surface portion has taken place, the floor surface portion is cleaned again, a further recording of the floor surface portion is created with an optical recording unit following the renewed cleaning and is compared with the first recording and/or the second recording to check the cleaning result. The control unit can initiate a renewed cleaning of the floor surface portion, which can be checked by means of the further recording by the optical recording unit. For example, following the first cleaning of the floor surface portion, the floor cleaning device reverses relative to the original cleaning direction and moves cleaning a further time over the floor surface portion in the cleaning direction.

It can be provided that at least the second recording is displayed on a display unit of the floor cleaning device or on a display unit arranged remote from the floor cleaning device (for example, a remote-control center). Preferably, both recordings are displayed on the display unit. An operating person guiding or remotely controlling the floor cleaning device can directly recognize and evaluate the cleaning result based upon the second recording or by comparison of the recordings.

Alternatively or additionally, it can be provided that with a control unit of the floor cleaning device or with a control unit arranged remote therefrom (for example, a remote-control center), a comparison of the recordings is undertaken and, on the basis thereof, an indication is displayable on the display unit that a sufficiently good cleaning has taken place. On the basis of the indication, the operating person can determine the satisfactory cleaning of the floor surface portion.

The indication can be stored in a memory unit as described above.

The display unit and/or the memory unit can also be arranged, as mentioned, in the remote-control center.

It is favorable if the position of the floor cleaning device on the floor surface is determined and recordings of the floor surface portion are linked to a position information item, if a reference recording of the floor surface portion in the cleaned state is stored linked to a position information item in a memory unit, and if the second recording is compared with the reference recording in order to check whether the floor surface portion can be regarded as sufficiently clean. This enables still better checking of the cleaning result. On a first learning transit of the floor cleaning device over the floor surface which has been cleaned and, in particular, is regarded as clean, reference recordings of floor surface portions can be created. The reference recordings can be stored in a memory unit linked to a position information item. The memory unit can be arranged in the floor cleaning device or in a remote-control center located remote therefrom. The second recording, linked to a position information item, can be compared with the reference recording of the same floor surface portion. By this means, it can be determined not only that the cleaning result is sufficiently good, but it can also be established whether the floor surface can be regarded as sufficiently clean.

Preferably, the method is carried out during the entire or substantially the entire cleaning of the floor surface. Gradually, the floor surface portions of the floor surface can be checked for sufficiently good cleaning.

As previously mentioned, a self-propelling and self-steering floor cleaning device can be used to clean the floor surface autonomously.

A manually guided floor cleaning device or a ride-on floor cleaning device can be used as the floor cleaning device. The floor cleaning device can be a walk-behind device.

For example, a suction unit, a sweeping unit, a scrubbing unit and/or a dirt uptake unit can be used as the cleaning unit.

The present invention further relates to a floor cleaning device for carrying out one of the methods mentioned above. The floor cleaning device comprises a carriage for traveling on a floor surface, at least one cleaning unit for cleaning the floor surface and at least one optical recording unit. During the cleaning movement of the floor cleaning device over the floor surface, a first recording of a floor surface portion before the cleaning is creatable with the at least one optical recording unit, the floor cleaning device is movable with the at least one cleaning unit over the floor surface portion and this is cleanable, and a second recording of the floor surface portion after the cleaning is creatable with the at least one optical recording unit. The recordings are comparable with one another in order to check the cleaning result.

The advantages achievable, as already set out in relation to the explanation of the method in accordance with the invention, can also be achieved using the floor cleaning device. In this regard, reference can be made to the above description. In a similar way, with regard to the advantageous embodiments mentioned below of the floor cleaning device in accordance with the invention, reference is made to the above-described advantageous exemplary embodiments of the method in accordance with the invention.

The at least one optical recording unit is preferably a camera, in particular a digital camera, and the recordings are favorably images of the floor surface portion.

It is advantageous if the floor cleaning device comprises two optical recording units, in particular, two cameras, in order to create the first recording and the second recording, wherein the first recording unit is provided for creating the first recording and, relative to a cleaning direction, is directed toward the floor surface in front of the at least one cleaning unit, and wherein the second recording unit is provided for creating the second recording and is directed toward the floor surface behind the at least one cleaning unit.

It can be provided that the first recording and the second recording are creatable with the same optical recording unit.

For example, at least one optical recording unit is movably mounted on the floor cleaning device and the recording unit is movable relative to the floor cleaning device following the creation of the first recording and the creation of the second recording.

The floor cleaning device preferably has a control unit for comparison of the recordings and an indication is providable at an indicating unit at least if no sufficiently good cleaning of the floor surface portion has occurred.

The indication can be storable, preferably linked to a position information item of the floor surface portion, in a memory unit wherein the position of the floor cleaning device on the floor surface is determinable by means of a localization unit.

The control unit and the localization unit can, in particular, form an integrated unit, for example, the localization unit is integrated into the control unit. In a corresponding manner, the memory unit can be integrated into the control unit. Preferably, the control unit, the memory unit and the localization unit form an integrated unit.

The floor cleaning device can comprise an indicating unit on which the indication is providable and/or a memory unit in which the indication is storable, preferably linked to the position information item.

The floor cleaning device can comprise a communication unit by means of which the indication is transferable to an indicating unit and/or a memory unit which is arranged remote from the floor cleaning device. The transfer takes place, for example, via a communication unit of a remote-control center to a control unit thereof, and from this to the indicating unit and/or the memory unit.

The indicating unit is preferably a display unit and comprises, in particular, an image display.

It proves to be favorable if a storage is also executable if a sufficiently good cleaning has taken place. Preferably, in this case, the indication is stored linked to a position information item of the floor surface portion.

It can naturally be provided that recordings of the floor surface portion can also be stored in a memory unit, preferably linked to a respective position information item. The memory unit can be a memory unit comprised by the floor cleaning device or a memory unit arranged remote therefrom, for example, the memory unit of a remote-control center.

It is favorable if the floor cleaning device is a self-propelling and self-steering floor cleaning device and that if no sufficiently good cleaning of the floor surface portion has taken place, the floor surface portion is cleanable again, a further recording of the floor surface portion is creatable with the at least one optical recording unit following the renewed cleaning and this is comparable with the first recording and/or the second recording in order to check the cleaning result.

The floor cleaning device can comprise a display unit on which at least the second recording is displayable.

Alternatively or additionally, the floor cleaning device can have a control unit for comparison of the recordings, wherein, on the basis of the comparison, an indication is displayable on the display unit that a sufficiently good cleaning has taken place.

The position of the floor cleaning device on the floor surface is preferably determinable by means of a localization unit, and the recordings of the floor surface portion are linkable to a position information item. In a memory unit, a reference recording of the floor surface portion in the cleaned state can be stored linkable to a position information item and the second recording can be comparable with the reference recording in order to check whether the floor surface portion can be regarded as sufficiently clean. The memory unit can be comprised by the floor cleaning device or can be arranged at a spacing therefrom, for example in a remote-control center for the floor cleaning device.

The floor cleaning device can be a self-propelling and self-steering floor cleaning device with which an autonomous cleaning of the floor surface is executable.

Alternatively or additionally, the floor cleaning device can be a manually guided floor cleaning device or a ride-on floor cleaning device.

The at least one cleaning unit can be or comprise a suction unit, a sweeping unit, a scrubbing unit and/or a dirt uptake unit.

The following description of preferred embodiments of the invention serves, together with the drawings, to provide a more detailed explanation of the invention. The advantageous embodiments of the floor cleaning device in accordance with the invention described below each enable the carrying out of the method in accordance with the invention.

FIG. 1 shows, in a schematic representation, a floor cleaning device in accordance with the invention assigned the reference numeral 10. The floor cleaning device 10 is herein configured as a scrubbing machine and comprises a carriage 12 for traveling on a floor surface 14 to be cleaned. For cleaning the floor surface 14, the floor cleaning device 10 comprises at least one cleaning unit 38. In the present case, the cleaning unit 38 comprises a scrubbing unit 16 and a dirt uptake unit 18. The scrubbing unit 16 permits the cleaning of the floor surface 14 with at least one rotary brush (not shown in the drawing), wherein the floor surface 14 is moistened with a cleaning fluid, in particular water, to enhance the cleaning effect. The mixture of loosened dirt and cleaning fluid is taken up from the floor surface 14 with the dirt uptake unit 18.

The floor cleaning device 10 is herein configured as a manually guided floor cleaning device which can be guided by an operating person (not shown) at an operating unit 20. In addition, the floor cleaning device 10 is configured self-steering and self-propelling. Without the presence of an operating person, the floor surface 14 can be cleaned autonomously.

It is also advantageous if the floor cleaning device 10 can be remotely controlled by an operating person (not shown) placed at a remote-control center 42. The floor surface 14 can thereby be cleaned by remote control of the floor cleaning device 10.

During the cleaning of the floor surface 14, the floor cleaning device 10 is typically moved along a cleaning direction 22. The cleaning direction 22 corresponds to a longitudinal direction of the floor cleaning device 10. During its straight ahead movement over the floor surface 14, the floor cleaning device 10 moves in the cleaning direction 22.

Figure 3:
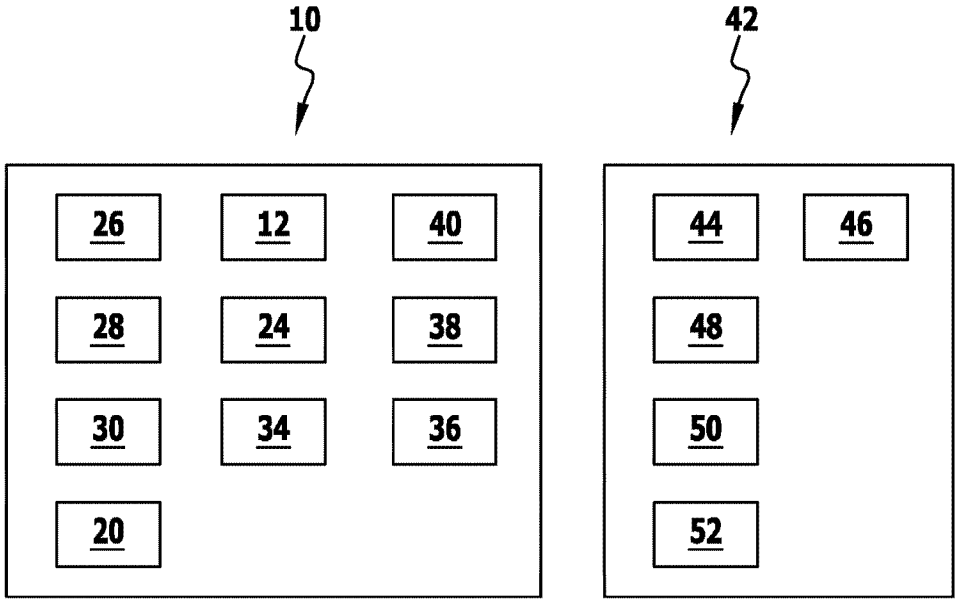
FIG. 3 is a schematic block circuit diagram of the floor cleaning device of FIG. 1 and an optionally present remote-control center for the floor cleaning device which is remote from the floor cleaning device.

FIG. 3 shows schematically a block circuit diagram of the floor cleaning device 10. The floor cleaning device 10 comprises a control unit 24, a first optical recording unit 26 and a second optical recording unit 28. Furthermore, a localization unit 30 is provided and the operating unit 20. The floor cleaning device 10 also has a memory unit 34 and an indicating unit 36. The indicating unit 36 comprises, in particular, an optical display unit, preferably with an image display. The at least one cleaning unit of the floor cleaning device 10 comprising the scrubbing unit 16 and the dirt uptake unit 18 is identified with the reference numeral 38. Optionally, a communication unit 40 is provided in order to transfer information to the remote-control center 42 which is arranged remote from the floor cleaning device 10.

The recording units 26, 28 are operatively connected to the control unit 24. Recordings of floor surface portions of the floor surface 14, as will be described below, can be transferred to the control unit 24. The control unit is also operatively connected to the memory unit 34, wherein the latter could also be integrated into the control unit 24.

In a corresponding manner, the control unit 24 is operatively connected to the localization unit 30, which could also be integrated into the control unit 24.

Input by an operating person at the operating unit 20 can be transferred to the control unit 24 and evaluated by it.

The control unit 24 can control the carriage 12 and the cleaning unit 38.

In a corresponding manner, the control unit 24 can control the indicating unit 36.

The control unit 24 can control the communication unit 40 in order to transfer data and/or information to the remote-control center 42. Conversely, the communication unit 40 can receive data and/or information and pass it on to the control unit 24.

The remote-control center 42 comprises a control unit 44, and, operatively connected thereto, an operating unit 46, a memory unit 48, an indicating unit (in particular, comprising a display unit) 50 and a communication unit 52.

The communication unit 52 cooperates with the communication unit 40 for the transfer of data and/or information. The memory unit 48 could also be integrated into the control unit 44. The indicating unit 50 is controllable by the control unit 44. Input by an operating person at the operating unit 46 can be transferred to the control unit 44 and transferred via the communication unit 52 to the floor cleaning device 10 when the latter is remotely controllable as described above.

The optical recording units 26, 28 are preferably cameras 54, 56, in particular digital cameras. The cameras 54, 56 are fixed, for example, to a housing 58 of the floor cleaning device 10 (FIG. 1), for example, close to the floor. However, they could also be arranged on the floor cleaning device by other means and/or at a different position. It is essential in the present case only that with the camera 54 a floor surface portion 60 which is positioned, relative to the cleaning direction 22, in front of the cleaning unit 38 is recordable. Accordingly, a field of view 62 of the camera 54 is directed to the floor surface 14. An image of the floor surface portion 60 recorded with the camera 54 can be fed to the control unit 24 and stored in the memory unit 34.

It is further essential that the camera 56 is directed to a floor surface portion 64 which is situated, relative to the cleaning direction 22, behind the cleaning unit 38. Accordingly, a field of view 66 of the camera 56 is directed to the floor surface 14. An image of the floor surface portion 64 that has been recorded with the camera 56 can be fed to the control unit 24 and also stored in the memory unit 34.

If the floor cleaning device 10 is moved, the floor surface portion 64 can match the floor surface portion 60 at a pre-determined time point. Therefore, the floor surface portion 60 of which images are recorded at different times will now be considered.

Figure 2A:
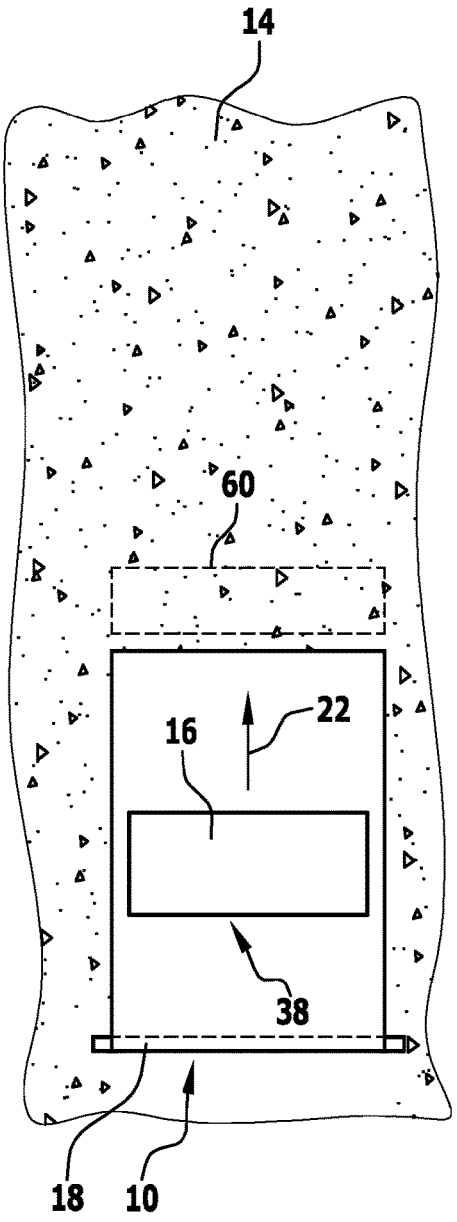
FIG. 2A is a plan view of the floor cleaning device of FIG. 1 at a first time point during the cleaning of a floor surface, wherein the floor cleaning device moves in a cleaning direction.
Figure 2B:
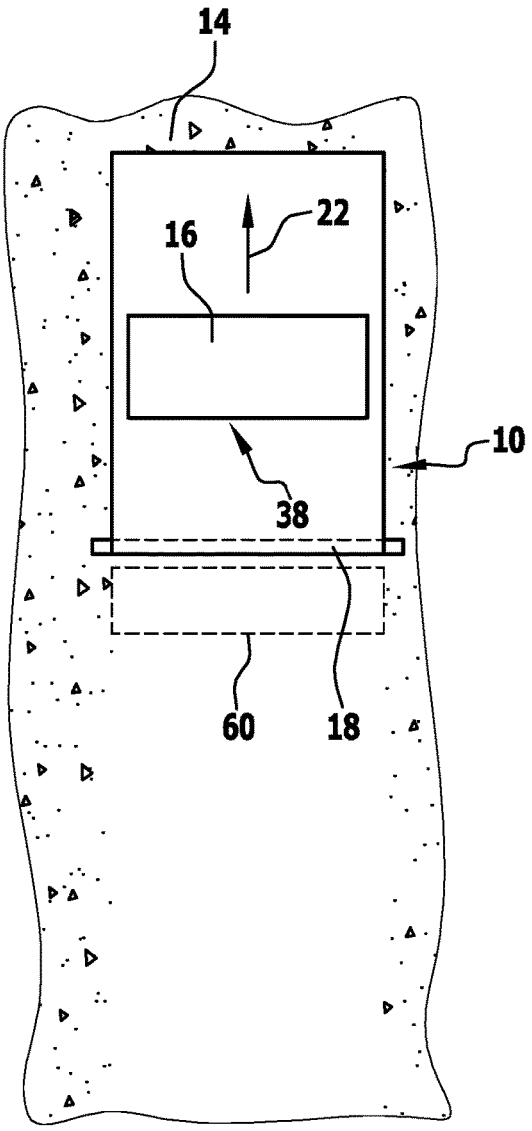
FIG. 2B is a representation as in FIG. 2A at a later time point during the cleaning of the floor surface.

If the floor cleaning device 10 moves over the floor surface, the possibility is thereby provided, in particular, of creating an image of the floor surface portion 60 with the camera 54, subsequently cleaning said floor surface portion with the cleaning unit 38 during the cleaning of the floor surface 14 and subsequently recording a second image of the floor surface portion 60 (i.e. at a later time point) with the camera 56. This is shown in FIGS. 2A and 2B, wherein the floor cleaning device 10 has moved relative to the floor surface 14 and thus relative to the floor surface portion 60. FIG. 2A shows the floor surface portion 60 before the cleaning and FIG. 2B shows the floor surface portion 60 after the cleaning.

For simplification, it will initially be assumed below that the floor cleaning device 10 carries out an autonomous cleaning of the floor surface 14. During the cleaning of the floor surface 14, a first image of the floor surface portion 60 to be cleaned is recorded and stored in the memory unit 34 (FIG. 2A). The floor cleaning device 10 is moved over the floor surface portion 60 and said floor surface portion is cleaned. Subsequently, a second image of the floor surface portion 60 is recorded (FIG. 2B). Preferably, the second image is also stored in the memory unit 34.

The control unit 24 can compare the two images with one another in order to check the cleaning result for the floor surface portion 60. For this purpose, for example, image processing algorithms can be stored executably in the control unit as well as at least one criterion, on the basis of which it can be determined whether a sufficiently good cleaning of the floor surface portion 60 has taken place.

During the continuing cleaning operation, the cleaning result is checked, wherein the floor surface 14 is examined section-wise, floor surface portion by floor surface portion. This is described using the example of the floor surface portion 60.

If a sufficiently good cleaning has taken place, preferably a suitable indication for the floor surface portion 60 is stored in the memory unit 34. The indication is preferably stored linked to a position information item for the floor surface portion 60. The position information item can be provided by means of the localization unit 30 with which the position of the floor cleaning device 10 on the floor surface 14 can be determined.

If the control unit 24 determines that the floor surface portion 60 has not been sufficiently well cleaned, this is preferably also stored in the memory unit 34, in particular linked to a position information item for the floor surface portion 60. In this case and in the case described above, the storage of the corresponding indication serves for documentation of the cleaning result. For example, on the basis of the documentation, it can be checked whether a cleaning instruction has been carried out satisfactorily.

In the event of insufficiently good cleaning, the floor cleaning device 10 stops, reverses opposite to the cleaning direction 22 and cleans the floor surface portion 60 again. Following the renewed cleaning of the floor surface portion 60, a further image thereof is recorded with the camera 56 and is compared with the first and/or second image. The control unit 24 determines by comparison whether the floor surface portion 60 has now been sufficiently well cleaned. If so, a corresponding indication, as described above, can be stored in the memory unit 34. If necessary, it can be provided that the floor surface portion 60 is cleaned a further time.

Checking of the cleaning result is executable during the cleaning of the floor surface 14. For this reason, only relatively little time is needed for a reliable cleaning of the floor surface 14. It is, in particular, not necessary to determine and store the degree of dirtiness of the floor surface 14 position-dependently before the start of cleaning as described in the prior art.

Preferably, a reference recording of the floor surface portion 60 is stored in the memory unit 34 linked to a position information item. The reference recording has been created, for example, during a learning movement with the floor cleaning device 10 over the floor surface 14 when the floor surface had a clean condition. In addition to the method described above, the possibility is thereby provided of determining, by means of a comparison of the second image of the floor surface portion 60 (in the cleaned state) whether the floor surface portion 60 can be considered sufficiently clean. This allows it to be determined whether the sufficiently good cleaning has led to the floor surface portion 60 being rendered clean.

It is hereinafter assumed that an operating person guides the floor cleaning device 10 over the floor surface 14 for cleaning. In this case also, a first image and a second image of the floor surface portion 60 are recorded and compared with one another. For example, the control unit 24 displays both images on the indicating unit 36 (the indicating unit 36 is arranged, for example, on the operating unit 20). This enables the operating person to establish visually whether a sufficiently good cleaning of the floor surface portion 60 has taken place. If not, the operating person can reverse and perform a renewed cleaning of the floor surface portion 14.

Alternatively or additionally, it can also be provided that the control unit 24 automatically carries out a comparison of the two images of the floor surface portion 60, as with autonomous cleaning. The control unit 24 can provide an indication at the indicating unit 36 to the operating person concerning the cleaning result. At least if no sufficiently good cleaning has taken place, a corresponding indication is provided. Preferably, a corresponding indication is also provided for a sufficiently good cleaning. This also enables the operating person to recognize insufficient cleaning processes and, if necessary, to undertake a renewed cleaning.

In the case, also, of manually guided operation of the floor cleaning device 10, an indication regarding the cleaning result, which arises from the comparison of the images by the control unit 24, is favorably stored in the memory unit 34. Herein also, the indication is preferably stored linked to a position information item for the floor surface portion 60.

In the case, also, of manually guided operation of the floor cleaning device 10, the cleaning result can thereby be stored for the entire floor surface 14 for the purpose of documentation.

Alternatively or additionally, with manually guided operation of the floor cleaning device 10, it can be provided that indications of whether the floor surface portion 60 has been sufficiently well cleaned can be transferred to the remote-control center 42. The indications can be stored, in particular, in its memory unit 48. Indications are stored at least if no sufficiently good cleaning has taken place. Preferably, a corresponding indication is also stored for a sufficiently good cleaning. The indications are preferably stored linked to a position information item of the floor surface portion 60, which can also be transferred to the remote-control center 42.

Naturally, for autonomous cleaning operation of the floor cleaning device 10 also, it can be provided that corresponding indications are transferred to the remote-control center 42 and stored there. It is also possible that the images that have been recorded with the cameras 54, 56 are stored in the memory unit 48.

It can even be provided that the comparison of the images is carried out by the control unit 44 and not by the control unit 24. In this case, instructions to reverse and to clean the floor surface portion 60 again can be transferred from the control unit 44 to the floor cleaning device 10.

It will now be considered that the floor cleaning device 10 is controlled by an operating person at the remote-control center 42 for cleaning the floor surface 14. The operating person can control the movement of the floor cleaning device 10 by means of the operating unit 46. The images of the floor surface portion 60 before the cleaning and after the cleaning are preferably transferred to the control unit 44. The images can be displayed on the indicating unit 50 so that the operating person can check the cleaning result and, if necessary, can undertake a renewed cleaning of the floor surface portion 60.

It can also be provided that the control unit 44 autonomously carries out a comparison of the images of the floor surface portion 60 and provides an indication to the operating person at the remote-control center 42 at least when no sufficiently good cleaning has taken place. Preferably, the indication is also provided on sufficiently good cleaning of the floor surface portion 60. The indication is displayed in particular on the indicating unit 50. The indication can be stored in the memory unit 48, preferably linked to a position information item.

It can also be provided that the control unit 24 undertakes a comparison of the images and transfers an indication regarding the cleaning result to the remote-control center 42.

Advantageous exemplary embodiments of the method in accordance with the invention have been described above using the example of the floor cleaning device 10 which can be configured self-propelling and self-steering and/or can be manually guided and/or can be remotely controlled. Naturally, it can also be provided that advantageous exemplary embodiments of the method can be carried out, also with only self-propelling and self-steering, only manually guided or only remotely controlled floor cleaning devices. The use of ride-on floor cleaning devices is also conceivable.

Figure 5:
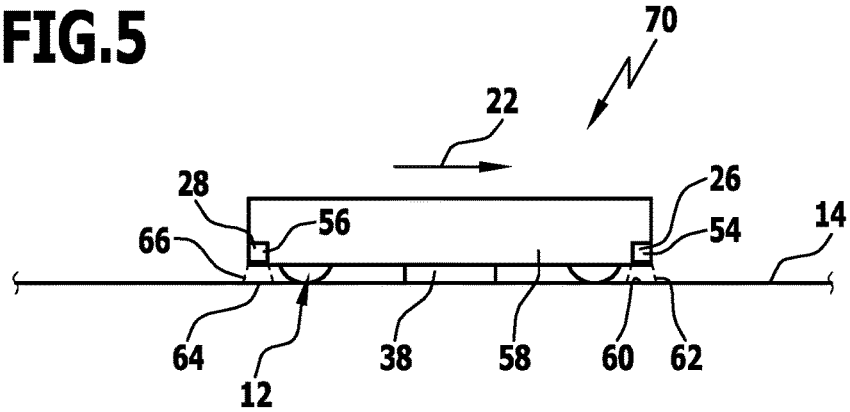
FIG. 5 is a schematic side view of a third preferred embodiment of the floor cleaning device in accordance with the invention.
Figure 4:
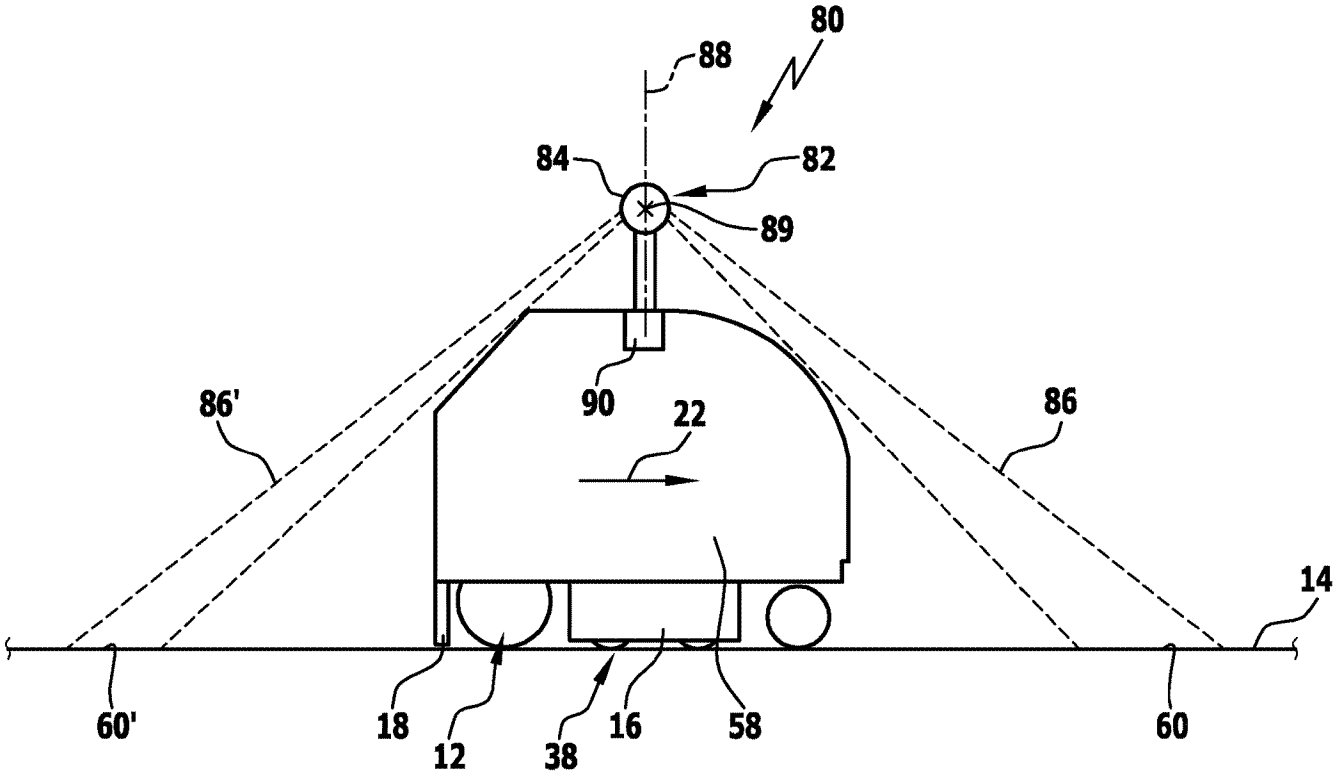
FIG. 4 is a schematic side view of a second preferred embodiment of the floor cleaning device in accordance with the invention.

FIGS. 4 and 5 show examples for self-propelling and self-steering floor cleaning devices for carrying out advantageous exemplary embodiments of the method. In this regard, reference is made to the above embodiments, which apply accordingly.

FIG. 5 shows schematically a floor cleaning device 70 which is configured as a sweeping-suction robot. For the same or similarly acting features of the floor cleaning devices 10 and 70, identical reference numerals are used. The advantages achievable with the floor cleaning device 10 can also be achieved with the floor cleaning device 70.

In the floor cleaning device 70, the cleaning unit 38 comprises a sweeping unit (not shown in the drawings), with which the floor surface 14 can be swept. The cleaning unit 38 further comprises a suction unit (also not shown) with which swept up dirt can be sucked up.

In the case of the floor cleaning device 70 also, the cameras 54, 56 are provided and, for example, held on the housing 58.

FIG. 4 shows, in a schematic representation, an advantageous embodiment of a floor cleaning device in accordance with the invention identified with the reference numeral 80.

In this case also, for the same or similarly acting features or components of the floor cleaning devices 10, 80, identical reference numerals are used. The advantages achievable with the floor cleaning device 10 can also be achieved with the floor cleaning device 80.

In the floor cleaning device 80, in this case a scrubbing machine, in place of the two recording units 26, 28, only one optical recording unit 82 is put to use. The recording unit 82 is configured as a camera 84, in particular a digital camera. The camera 84 has a field of view 86 which is directed to the floor surface 14.

The camera 84 is movably held on the floor cleaning device 80. In particular, the camera 84 is mounted rotatable about a rotation axis 88. In order to rotate the camera 84, the floor cleaning device 80 has a drive unit 90 which is controllable by the control unit 24.

The rotation axis 88 is oriented perpendicularly to a contact plane defined by the carriage 12, said contact plane coinciding with the plane of the floor surface 14. In the case of a horizontal floor surface 14, the rotation axis 88 is therefore oriented vertically.

In the floor cleaning device 80, both images of the floor surface portion 60 are created with the camera 84. The first image of the floor surface portion 60 before the cleaning is created in that the field of view 86 is directed to a region on the floor surface 14 situated in front of the cleaning unit 38 in the cleaning direction 22 (to the right in FIG. 4).

After the recording of the first image, the camera 84 is rotated so that the field of view is directed toward a portion on the floor surface 14 which is situated behind the cleaning unit 38 in the cleaning direction 22. After the cleaning of the floor surface portion 60, the second image thereof is recorded. This is shown in FIG. 4 on the left. The field of view following the cleaning of the floor surface portion is identified with the reference numeral 86' and the floor surface portion following the cleaning is identified with the reference numeral 60'. This allows the method in accordance with the invention to be carried out with just one camera 84.

Alternatively or additionally to the rotation possibility about the rotation axis 88, it can be provided that the camera 84 is rotatable about a rotation axis 89. The rotation axis 89 is oriented perpendicularly to the cleaning direction 22 and parallel to the contact plane (in FIG. 4, horizontally and perpendicularly to the drawing plane). In order to rotate the camera 84, a drive unit (not shown in the drawing) is provided which is controllable by the control unit 24.

In a further advantageous embodiment not shown in the drawings, it can be provided that the field of view of the camera used is so great that it extends on the floor surface 14 from a portion lying in front of the cleaning unit 38 to a portion lying behind the cleaning unit 38 (each relative to the cleaning direction 22). A movable camera 84 can thus be spared.

The invention claimed is:

1. A method for cleaning a floor surface with a floor cleaning device, the floor cleaning device comprising a carriage for traveling on the floor surface, in which method, during a cleaning movement of the floor cleaning device over the floor surface, a first recording of a floor surface portion is created with an optical recording unit before the cleaning, the floor cleaning device is moved with at least one cleaning unit over the floor surface portion, which is cleaned, a second recording of the floor surface portion is created with an optical recording unit after the cleaning, and the recordings are compared with one another in order to check a cleaning result, wherein the comparison of the recordings is undertaken by a control unit of the floor cleaning device and at an indicating unit, at least if no sufficiently good cleaning of the floor surface portion has occurred, a corresponding indication is provided and/or is stored with a position information item of the floor surface portion in a memory unit, wherein the position of the floor cleaning device on the floor surface is determined by means of a localization unit.

2. The method in accordance with claim 1, wherein as optical recording unit there is used a camera, and wherein the recordings are images of the floor surface portion.

3. The method in accordance with claim 1, wherein two optical recording units are used in order to create the first recording and the second recording, wherein the first recording unit is provided for creating the first recording and, relative to a cleaning direction, is directed toward the floor surface in front of the at least one cleaning unit, and wherein the second recording unit is provided for creating the second recording and is directed toward the floor surface behind the at least one cleaning unit.

4. The method in accordance with claim 1, wherein there is used one optical recording unit which creates the first recording and the second recording.

5. The method in accordance with claim 4, wherein the optical recording unit is movably mounted on the floor cleaning device, and wherein the recording unit is moved relative to the floor cleaning device after the creation of the first recording to create the second recording.

6. The method in accordance with claim 1, wherein the indication is provided at at least one of an indicating unit of the floor cleaning device and an indicating unit arranged remote from where the floor cleaning device.

7. The method in accordance with claim 1, wherein the indication is stored in at least one of a memory unit of the floor cleaning device and a memory unit arranged remote from where the floor cleaning device is used.

8. The method in accordance with claim 1, wherein a storage is also carried out if a sufficiently good cleaning has taken place.

9. The method in accordance with claim 1, wherein, in the case that the floor cleaning device is a self-propelling and self-steering floor cleaning device and no sufficiently good cleaning of the floor surface portion has taken place, the floor surface portion is cleaned again in a renewed cleaning, a further recording of the floor surface portion is created with an optical recording unit following the renewed cleaning and the further recording is compared with at least one of the first recording and the second recording in order to check the cleaning result.

10. The method in accordance with claim 1, wherein at least the second recording is displayed on a display unit of the floor cleaning device or on a display unit arranged remote from the floor cleaning device.

11. The method in accordance with claim 1, wherein, on the basis of the comparison, an indication is displayable on a display unit of the floor cleaning device that a sufficiently good cleaning has taken place.

12. The method in accordance with claim 1, wherein a reference recording of the floor surface portion in a cleaned state is stored with a position information item in the memory unit, and wherein the second recording is compared with the reference recording in order to check whether the floor surface portion can be regarded as sufficiently clean.

13. The method in accordance with claim 1, wherein the method is carried out during an entire or substantially an entire cleaning of the floor surface.

14. The method in accordance with claim 1, wherein a self-propelling and self-steering floor cleaning device is used.

15. The method in accordance with claim 1, wherein a manually guided floor cleaning device or a ride-on floor cleaning device is used.

16. A floor cleaning device comprising a carriage for traveling on a floor surface, at least one cleaning unit for cleaning the floor surface and at least one optical recording unit, wherein during a cleaning movement of the floor cleaning device over the floor surface, a first recording of a floor surface portion is creatable with the at least one optical recording unit before the cleaning, the floor cleaning device is movable with the at least one cleaning unit over the floor surface portion and this is cleanable, and a second recording of the floor surface portion is creatable with the at least one optical recording unit after the cleaning, wherein the recordings are comparable with one another in order to check a cleaning result, wherein the floor cleaning device has a control unit for comparison of the recordings and wherein an indication is providable at an indicating unit at least if no sufficiently good cleaning of the floor surface portion has occurred, and/or is storable with a position information item of the floor surface portion in a memory unit, wherein the position of the floor cleaning device on the floor surface is determinable by means of a localization unit.

17. The floor cleaning device in accordance with claim 16, wherein the at least one optical recording unit is a camera, and wherein the recordings are images of the floor surface portion.

18. The floor cleaning device in accordance with claim 16, wherein the floor cleaning device comprises two optical recording units in order to create the first recording and the second recording, wherein the first recording unit is provided for creating the first recording and, relative to a cleaning direction, is directed toward the floor surface in front of the at least one cleaning unit, and wherein the second recording unit is provided for creating the second recording and is directed toward the floor surface behind the at least one cleaning unit.

19. The floor cleaning device in accordance with claim 16, wherein the first recording and the second recording are creatable with the same optical recording unit.

20. The floor cleaning device in accordance with claim 19, wherein the at least one optical recording unit is movably mounted on the floor cleaning device, and wherein the at least one optical recording unit is movable relative to the floor cleaning device after the creation of the first recording and to create the second recording.

21. The floor cleaning device in accordance with claim 16, wherein the floor cleaning device comprises at least one of an indicating unit on which the indication is providable and a memory unit in which the indication is storable, linked to the position information item.

22. The floor cleaning device in accordance with claim 16, wherein the floor cleaning device comprises at least one of a communication unit by means of which the indication is transferable to an indicating unit and a memory unit arranged remote from the floor cleaning device.

23. The floor cleaning device in accordance with claim 16, wherein a storage is also executable if a sufficiently good cleaning of the floor surface portion has taken place.

24. The floor cleaning device in accordance with claim 16, wherein the floor cleaning device is a self-propelling and self-steering floor cleaning device and wherein, if no sufficiently good cleaning of the floor surface portion has taken place, the floor surface portion is cleanable again, a further recording of the floor surface portion is creatable with the at least one optical recording unit following the renewed cleaning and this is comparable with at least one of the first recording and the second recording in order to check the cleaning result.

25. The floor cleaning device in accordance with claim 16, wherein the floor cleaning device comprises a display unit on which at least the second recording is displayable.

26. The floor cleaning device in accordance with claim 16, wherein the floor cleaning device has a control unit for comparison of the recordings, wherein, on the basis of the comparison, an indication is displayable on a display unit of the floor cleaning device that a sufficiently good cleaning has taken place.

27. The floor cleaning device in accordance with claim 16, wherein the position of the floor cleaning device on the floor surface is determinable by means of a localization unit and the recordings of the floor surface portion are linkable to the position information item, wherein a reference recording of the floor surface portion in a cleaned state is storable with the position information item in a memory unit, and wherein the second recording is comparable with the reference recording in order to check whether the floor surface portion can be regarded as sufficiently clean.

28. The floor cleaning device in accordance with claim 16, wherein the floor cleaning device is a self-propelling and self-steering floor cleaning device.

29. The floor cleaning device in accordance with claim 16, wherein the floor cleaning device is a manually guided floor cleaning device or a ride-on floor cleaning device.

* * * * *